United States Patent [19]

Hunyadi

[11] 4,277,781

[45] Jul. 7, 1981

[54] CLOSURE ALARM WITH THREE-WAY SWITCH

[75] Inventor: Steve Hunyadi, Pepper Pike, Ohio

[73] Assignee: Castle Keep, Inc., Wickliffe, Ohio

[21] Appl. No.: 127,934

[22] Filed: Mar. 7, 1980

[51] Int. Cl.[3] ..... G08B 13/08

[52] U.S. Cl. ..... 340/545; 200/61.19; 200/61.62; 200/61.93

[58] Field of Search ..... 340/545, 546, 548; 200/61.19, 61.62, 61.71, 61.72, 61.93

[56] References Cited

U.S. PATENT DOCUMENTS

| | | | |
|---|---|---|---|
| 783,399 | 2/1905 | Blank | 340/545 |
| 1,649,534 | 11/1927 | Lawhon | 340/545 |
| 2,984,718 | 5/1961 | Fish | 200/61.72 |
| 3,312,968 | 4/1967 | Kiefer, Jr. | 390/545 |
| 3,440,635 | 4/1969 | Hull | 200/61.19 |

*Primary Examiner*—Glen R. Swann, III

*Attorney, Agent, or Firm*—Maky, Renner, Otto & Boisselle

[57] ABSTRACT

A closure alarm contains a switch formed of a pair of axially aligned rounded-end contacts spring biased into end-to-end contact. A pivoted operating arm has a thin, knife - like insulating portion which is interposed between the contacts when the lever is in its active position. Opening movement of the closure, when the operating lever is in its active position, contacts the operating lever to pivot the lever to withdraw the insulating portion, allowing the contacts to close an alarm circuit. The lever is frictionally restrained from returning to its initial position, so the alarm is latched. The operating lever can be pivoted 180 degrees to an inactive position in which a second thin, knife-like insulating portion separates the switch contacts but the lever is out on the path of the closure, so the alarm circuit is off. An arm is mounted on the closure by a bracket in one of two positions: active or inactive. If the operating lever is positioned between its active and inactive positions and the arm is placed in its active position, an insulating portion of the arm is aligned with the switch contacts. Therefore, if the closure is opened, the contacts close the alarm circuit, but if the closure is then closed, the arm moves with the closure to again separate the contacts and silence the alarm. Thus, a non-latching mode of operation is provided.

11 Claims, 8 Drawing Figures

CLOSURE ALARM WITH THREE-WAY SWITCH

BACKGROUND OF THE INVENTION

In known self-contained burglar alarms three switches are generally employed, namely a door switch which closes the alarm circuit upon opening of the door, a holding circuit switch which maintains the alarm signal device in energized condition despite reclosing of the door, and an on-off switch which in off position deactivates the alarm to open the door switch and holding switch circuits for deenergization of the alarm signal device. In such known alarm, should it be desired to operate the alarm so that the signal device is energized when the door is opened and is deenergized when the door is closed, then a fourth switch could be provided to open or bypass the holding circuit.

SUMMARY OF THE INVENTION

In contradistinction to known alarms, a single switch in the alarm takes the place of the four switches required in known alarms. The alarm herein has a switch operating lever which has an active position in which it closes the alarm circuit switch upon opening of the door and remains in switch closing position despite subsequent reclosing of the door; an inactive position whereat the alarm signal switch is held open so that the door may be opened and closed without setting off the alarm; and an intermediate position whereat a switch operating arm on the door closes the alarm signal switch when the door is opened and opens the alarm signal switch when the door is closed. The switch operating arm on the door also has an inactive position so as to leave the control of the alarm signal switch to the switch operating lever according to whether it is in its active, inactive or intermediate position.

DETAILED DESCRIPTION OF A PREFERRED EMBODIMENT

Figure 1:
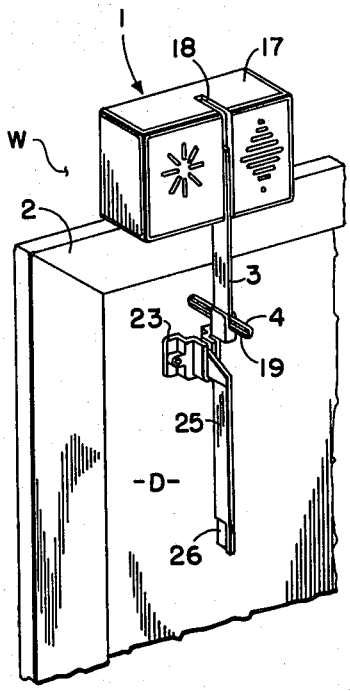
FIG. 1 is a perspective view of the upper portion of a doorway and door showing the alarm in active position in which even a minute opening of the door will close the alarm signal switch to energize the alarm signal device.

In FIGS. 1–7 the burglar alarm 1 constituting the present invention is shown in connection with a conventional hinged door D, the alarm 1 being preferably mounted on the wall W just above the top door trim 2 with its switch actuating lever 3 extending downwardly for engagement of its laterally adjustable member 4 by the door D upon opening movement thereof.

By way of example only, the doorway construction may be conventional and the door frame may include header and door jambs 5.

The alarm 1 basically comprises a base plate 6 which, for economy of manufacture and for efficiency, is molded of suitable plastic material and provided with holes for mounting screws 7 which may be of any desired form depending upon the nature of the wall W. The base plate 6 has integral projecting pins and notches as shown to snugly support the batteries B1 and B2 of which the battery B2 is a spare. The base plate 6 has an opening for a screw 8 by which the alarm signal device 9 is mounted on the base plate 6. Preferably the signal device 9 constitutes a diaphragm horn which emits a loud and shrill signal when energized.

Figure 5:
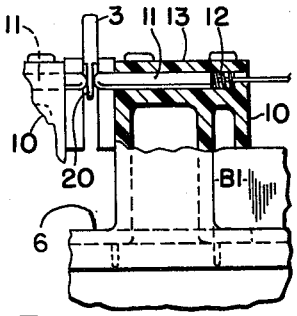
FIG. 5 is a partial cross-section view showing the details of the alarm signal switch.

The base plate 6 also has integral laterally projecting block-like portions 10 provided with aligned grooves to slidably receive the switch contacts 11 which are biased by springs 12 into end-to-end contact of their respective rounded ends. The grooves are closed as by plates 13 having holes fitted over integral pins of the blocks, the plates 13 being permanently affixed as by heat and pressure applied on the upper projecting ends of the block pins as shown in FIG. 5. The contacts 11 are crimped or otherwise secured to the wires from the battery B1 and to the signal device 9 respectively and the insulated portions of the wires are slidable in the narrower and shallower portions of the grooves.

The base plate 6 is also provided with integral bosses 14 providing a pair of grooves in which the oppositely disposed and aligned pins 15 of the switch operating lever 3 are snap fitted to provide a friction pivot parallel to the axis of the contacts 11.

The base plate 6 is provided at opposite sides with slight projections 16 which snap into corresponding recesses on the inside of the plastic cover member 17 which is provided with suitable openings for emission of the sound from the signal device 9. In addition, the cover member 17 has a slot 18 to permit movement of the switch operating lever 3 between the active and inactive positions as shown in FIGS. 1–3 and FIG. 6, respectively.

The switch operating lever 3 is also preferably molded of plastic material and has adjacent its end remote from the pins 15 a laterally disposed slot therethrough in which the door engaging member 4 is adjustable longitudinally and frictionally retained in adjusted position by making the thickness of the member 4 across the longitudinal ribs 19 thereof slightly greater than the width of said slot. The member 4 is also preferably of plastic material.

Figure 2:
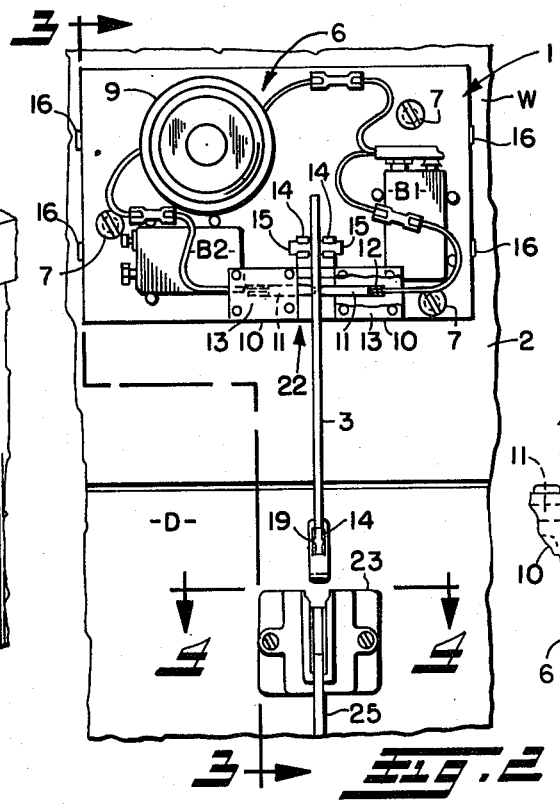
FIG. 2 is a front elevation view on somewhat enlarged scale with the cover of the alarm removed to show components of the alarm.
Figure 4:
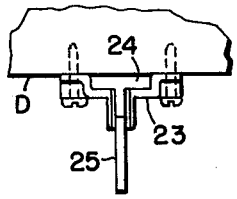
FIG. 4 is a top plan view as viewed along the line 4—4 of FIG. 2.
Figure 3:
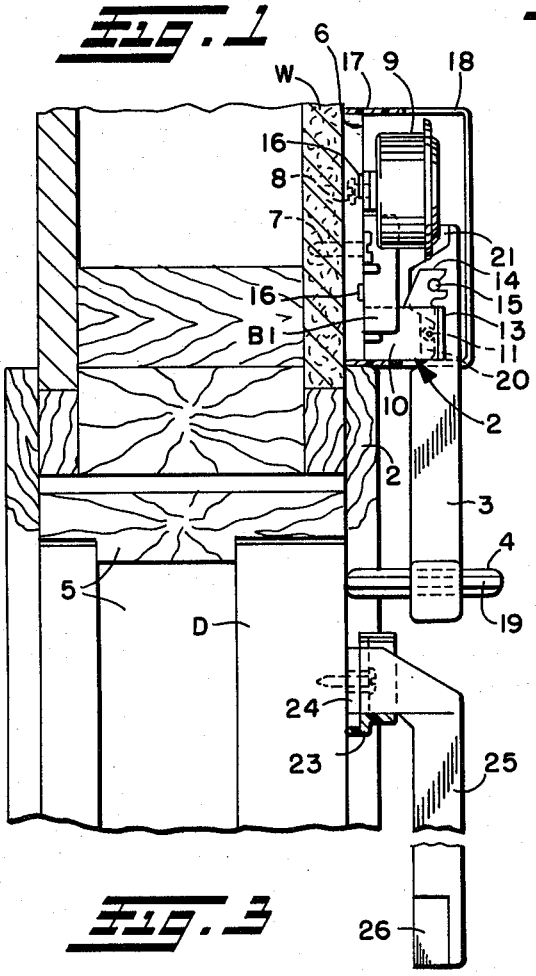
FIG. 3 is a cross section view taken substantially along the line 3—3 of FIG. 2.
Figure 6:
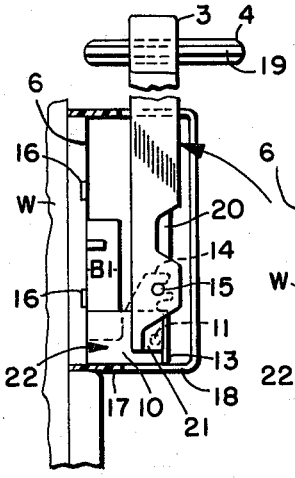
FIG. 6 is a side elevation of the switch operating lever showing the same in its inactive position whereas said lever is shown in active position in FIG. 3.

The switch operating lever 3 has two thin blade-like portions 20 and 21 of which the blade-like portion 20 is wedged between the rounded ends of the contacts 11 to open the switch 22 when the switch operating lever 3 is disposed in active position as shown in FIGS. 1, 2 and 3, and of which the blade-like portion 21 is so interposed between the contacts 11 when the switch operating lever 3 is in inactive position as shown in FIG. 6.

The battery B1, switch 22, and alarm signal device 9 are wired in series circuit arrangement as clearly shown in FIG. 2 so that the signal device 9 is deenergized when the contacts 11 are separated by one or the other of the blade-like portions 20 or 21 of the lever 3 and so that the signal device 9 is energized when the contacts 11 are in end-to-end engagement effected by withdrawal of the blade-like portion 20 or 21 from between the contacts 11.

When the alarm 1 is set as shown in FIGS. 1, 2 and 3 a slight opening movement of the door D will cause a swinging of the lever 3 about the pivot 15 to withdraw the blade-like portion 20 from between the contacts 11 whereby the springs 12 will bias the contacts 11 into end-to-end engagement to close the switch 22 and thereby energize the signal device 9. If the door D is reclosed, the switch 22 will remain closed to continually energize the signal device 9 and even if the door D is opened so that the lever 3 is swung up over the upper edge of the door D it will remain there owing to the friction pivot 15, and again, the reclosing of the door D will not open the alarm switch 22.

When it is desired to deactivate the alarm 1, the lever 3 will be swung up to the FIG. 6 position in which the blade-like portion 21 will be interposed between the contacts 11 to hold the switch 22 open whereby the door D may be opened and closed without setting off the alarm 1.

Figure 7:
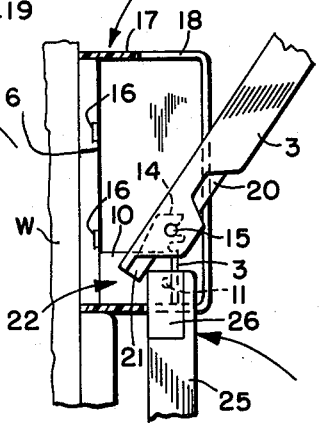
FIG. 7 is similar to FIG. 6 except showing the switch operating lever in an intermediate position whereat a switch operating arm on the door is operative to open and close the alarm signal switch when the door is closed and opened.

Another feature of the present alarm 1 is that there is mounted on the door D a bracket 23 which provides a T-slot for the flanged portion 24 of a plastic switch operating arm 25 which is shown in downwardly extending inactive position in FIGS. 1–4. When the arm 25 is inverted to active position, as shown in FIG. 7, while the lever 3 is in intermediate position, closing of the door D will cause the thin blade-like portion 26 at the upper end of the arm 25 to be interposed between the contacts 11 to open the alarm circuit and when the door D is opened the blade-like portion 26 of the arm 25 is withdrawn from between the contacts 11 so that the springs 12 will bias the contacts 11 into end-to-end engagement to energize the alarm signal device 9. Of course, when the door D is reclosed the blade-like portion 26 will become wedged between the contacts 11 to open the alarm signal circuit.

Figure 8:
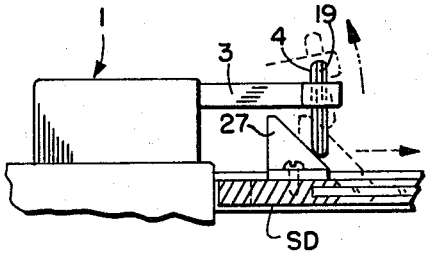
FIG. 8 is a top plan view showing the alarm herein for operation in connection with a sliding door or window.

In FIG. 8, the alarm 1 herein is shown fixedly mounted on the side of a sliding door SD (or window). In this case, a cam 27 is mounted onto the door SD so that when the door is opened by movement toward the right as viewed in FIG. 8, the cam 27 will cause swinging of the switch operating lever 3 to the phantom line position thus to withdraw the thin blade-like portion 20 from between the contacts 11 thus to close the alarm circuit.

The embodiments of the invention in which an exclusive property or privilege is claimed are defined as follows:

1. An alarm for detecting opening movement of a closure member for an opening in a building structure comprising an alarm unit adapted for fixed mounting adjacent said closure member; said unit having an electrically operated alarm signal means, a switch, and a battery electrically interconnected to energize and deenergize said signal means upon closing and opening of said switch; said switch comprising a pair of coaxial rounded-end contacts which are spring biased into end-to-end contact; said unit having a switch operating lever pivotally connected thereto about an axis parallel to that of said contacts; said lever having a thin blade-like insulated portion which in active position of said lever is wedged between said contacts to open said switch and which is withdrawn therefrom to close said switch upon swinging of said lever in response to opening movement of said closure member; said lever having another thin blade-like insulated portion which is interposed between said contacts in an inactive position of said lever whereat said lever clears the path of opening and closing movements of said closure member.

2. The alarm of claim 1 wherein said pivotal connection retains said lever in switch closing position despite reclosing movement of said closure member.

3. The alarm of claim 1 wherein said lever has an intermediate position whereat said switch is closed; and wherein an arm on said closure member has an active position whereat a thin blade-like insulating portion which is interposed between and withdrawn from between said contacts responsive to closing and openings movements of said closure member while said lever is in said intermediate position.

4. The alarm of claim 3 wherein said closure member has a bracket thereon which selectively supports said arm in an active position as aforesaid or in an inactive position for opening and closing of said switch by said lever.

5. The alarm of claim 1 wherein said lever has a laterally adjustable member which in said active position is adjusted to effect swinging movement of said lever during initial opening movement of said closure member.

6. The alarm of claim 5 wherein said adjustable member is snugly slidably movable in an opening through said lever thus to frictionally retain said member in adjusted position.

7. The alarm of claim 1 wherein said closure member is a hinged door which upon opening movement engages said lever to effect closing of said switch.

8. The alarm of claim 1 wherein said closure member is a sliding door or window having a cam thereon operative to engage said lever upon opening movement thus to effect closing of said switch.

9. The alarm of claim 1 wherein said unit comprises a base plate of plastic material to which said signal means is secured and having battery holding means; said base plate having spaced apart lateral projections in which the respective contacts are longitudinally slidable into and out of end-to-end contact; said base plate further having a lateral projection providing a snap-fit pivot connection with opposite cylindrical pin portions of said lever located between said blade-like portions; and a removable cover member detachably snap-fitted over said base plate to enclose said battery, switch, and signal means; said cover member having a slot therethrough for swinging movement of said lever between active and inactive positions.

10. The alarm of claim 9 wherein said lever has an intermediate position whereat both blade-like portions are withdrawn from between said contacts; and wherein an arm on said closure member has a thin blade-like insulating portion interposed between and withdrawn from between said contacts responsive to closing and opening movements of said closure member while said lever is in said intermediate position.

11. The alarm of claim 10 wherein said closure member has a bracket which selectively supports said arm in active position as aforesaid and in an inactive position whereat said switch is opened or closed by said lever.

* * * * *